US005689079A

United States Patent [19]

Kosugi

[11] Patent Number: 5,689,079

[45] Date of Patent: Nov. 18, 1997

[54] MUSICAL TONE GENERATOR

[75] Inventor: Taichi Kosugi, Shizuoka-ken, Japan

[73] Assignee: Kabushiki Kaisha Kawai Gakki Seisakusho, Japan

[21] Appl. No.: 452,304

[22] Filed: May 26, 1995

[30] Foreign Application Priority Data

May 31, 1994 [JP] Japan ..... 6-139613

[51] Int. Cl.[6] ..... G10H 7/00; G10H 7/02

[52] U.S. Cl. ..... 84/603; 84/604

[58] Field of Search ..... 84/603, 604, 605, 84/606, 607; 364/723

[56] References Cited

U.S. PATENT DOCUMENTS 4,901,615 2/1990 Matsushimma et al. ..... 84/605

5,194,681 3/1993 Kudo ..... 84/603

5,252,773 10/1993 Kozui et al. ..... 84/607

5,432,293 7/1995 Nonaka et al. ..... 84/607

*Primary Examiner*—William M. Shoop, Jr.

*Assistant Examiner*—Marlon Fletcher

*Attorney, Agent, or Firm*—Westman, Champlin & Kelly, P.A.

[57] ABSTRACT

In a musical tone generator 6 having a waveform memory 8, and an interpolatory calculation circuit 21 for performing an interpolatory calculation on the basis of the plurality of sample values, there are provided a second waveform memory in which the sample values necessary for the interpolatory calculation at the beginning of tone generating are stored, and a transfer circuit for reading out the sample values from the second waveform memory at the beginning of tone generating, and writing them into the interpolation means.

8 Claims, 8 Drawing Sheets

WA[N] :WAVEFORM ADDRESS OF CHANNEL [N]

DA :ADDRESS FOR ACCESSING DELAY RAM

MUSICAL TONE GENERATOR

BACKGROUND OF THE INVENTION

1. Field of the Invention

The present invention is related to a musical tone generator for use with an electronic musical instrument, and particularly to the control of the musical tone generator at the beginning of tone generating.

2. Description of the Prior Art

Conventionally, in the musical tone generator of an electronic musical instrument or the like, there was a method in which the sample values of musical tone waveforms were stored in a memory, and a musical tone is generated by reading out such waveform data at a read frequency (address interval) corresponding to a desired pitch. The musical tone generator circuit of this method included the one which performs the interpolatory calculation of a read sample value to reduce the noise. To perform the interpolatory calculation of a sample value, a plurality of sample values in the vicinity of (at least before and after) the phase information of a musical tone waveform to be generated are required. Since the number of musical tone generating channels is increasing recently in the musical tone generator circuit, to read out from the waveform memory all the waveform sample values necessary for the interpolation in synchronism with the time-shared calculation timing of each generating channel requires a very fast memory, and it is not economical.

Accordingly, there was a method in which a memory means is provided for each channel for temporarily storing a plurality of sample values in the vicinity of the phase information read out by that point of time, and the memory means is used to perform an interpolatory calculation. The update of the contents of the memory means is carried out when the integral part of the phase information of a musical tone to be generated (namely, the read address of the waveform memory) is incremented. However, there was a problem that, in this method, the interpolation result becomes an invalid value since the contents of the memory means assume values which are unrelated to the tone generating at the beginning of the tone generating. Thus, to solve this problem, a method was proposed in which the contents of the memory means are reset to, for instance, zero, but this method had a problem that the rise characteristics of a musical tone are impaired.

There is a further method such as disclosed in the Patent Application Laid-open No. JP, A3-269597 official gazette. That is, only at the beginning of tone generating, the manner of generating a waveform address is altered so that sample values are transferred in a short time from the waveform memory to a memory means for temporarily storing the waveform sample values for interpolation.

In the conventional musical tone generator as described above, particularly in the last method, a fast memory need not be used and the rise characteristics are not impaired, but there was a problem that a complex circuit for generating a waveform memory read address is required to implement this method.

SUMMARY OF THE INVENTION

It is the object of the present invention to provide a musical tone generator which has a simple construction and does not degrade the rise characteristics at the beginning of tone generating.

The present invention is a musical tone generator having a first waveform memory means, and an interpolation means for performing an interpolatory calculation on the basis of a plurality of sample values read out from the first waveform memory means, characterized by providing a second waveform memory means in which sample values necessary for the interpolatory calculation at the beginning of tone generating are stored, and a transfer means for reading out the sample values from the second waveform memory means and writing them into the interpolation means.

In the present invention, since the control device, which is the transfer means, uses such means to write a plurality of sample values necessary for an interpolatory calculation into the interpolation means at the beginning of tone generating, a correct interpolatory calculation can be carried out from the first output and degradation of the rise characteristics is eliminated. Further, the present invention can be implemented only by adding a circuit for writing data from the control device into the memory means within the interpolation circuit, without adding any circuit to the waveform memory read address generator circuit. Moreover, since the control device is usually comprised of a microprocessor (CPU), a new memory is not required if a plurality of waveform sample values necessary for the interpolatory calculation at the beginning of tone generating are previously stored, for instance, in a ROM for a program. In addition, the data stored in the ROM need not be redundantly stored in the waveform memory.

DETAILED DESCRIPTION OF THE INVENTION

Figure 1:
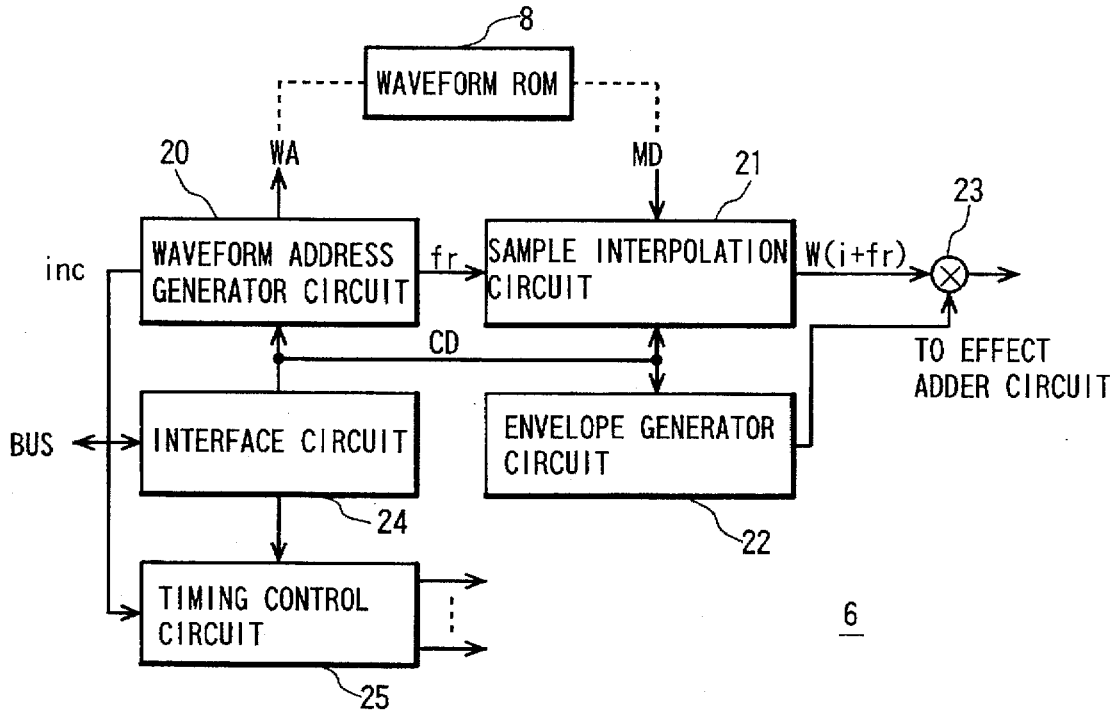
FIG. 1 is a block diagram showing the construction of the musical tone generator circuit 6 of the present invention.

Now, an embodiment of the present invention is described in detail with reference to the drawing.

Figure 2:
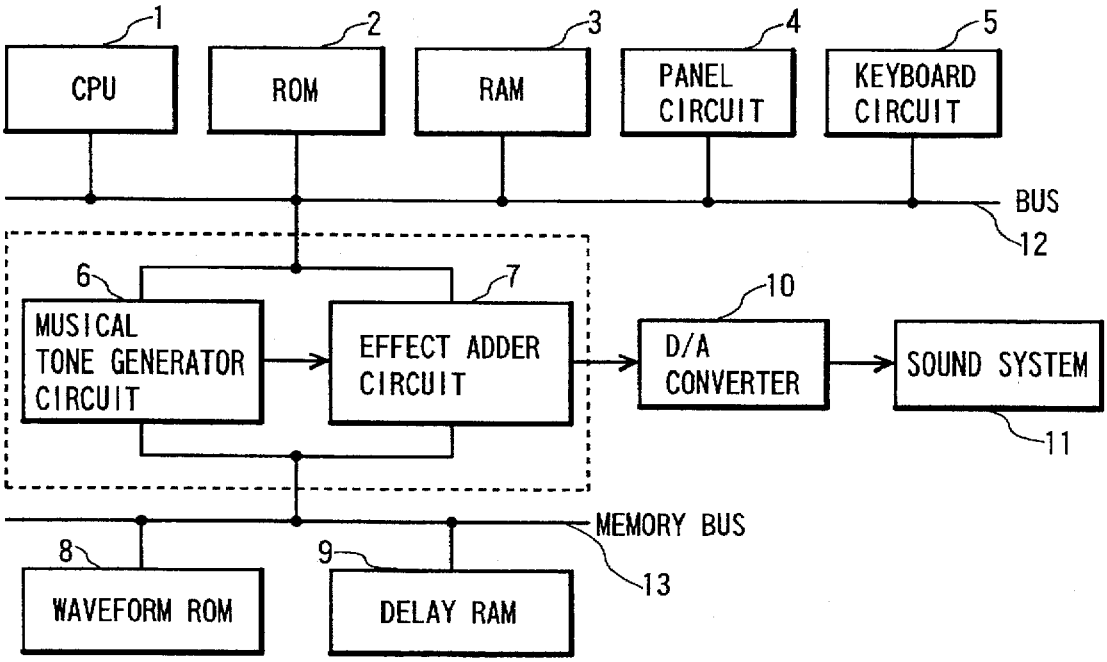
FIG. 2 is a block diagram showing the hardware configuration of the electronic musical instrument of the present invention.

FIG. 2 is a block diagram representing the hardware configuration of an electronic musical instrument to which the present invention was applied. A CPU 1 is a microprocessor which performs the control of the whole electronic musical instrument such as key assignment and tone generating control. It also includes a timer interruption circuit.

Stored in a ROM 2 are a control program, a tone color parameter, a frequency information table, a microprogram for controlling the operation of an effect adder circuit, and performance data for an automatic performance. The tone color parameter is made up of waveform address information, the waveform sample initial values related to the present invention, waveform sampling rates, envelope control information, and the like. Further, the frequency information table is a data table for determining the frequency of reading out waveforms (address interval) from the pitch (key number) and the waveform sampling rate.

Stored in a RAM 3 are various control data in the musical instrument, the present state of a panel circuit 4, inputted performance data, and the like. The panel circuit 4 consists of various switches such as a tone color selection switch, an effect selection switch, an effect addition rate setting switch and a volume setting switch, a display device such as an LED or LCD, and the interface circuit therefor. A keyboard circuit 5 consists of a plurality of keys each having two switches for instance, a scan circuit for reading the state of the switches, a key event detection circuit for detecting a key-on/off according to the state change of a switch, a touch detection circuit for detecting the strength of a key depression, etc.

A musical tone generator circuit 6 is a circuit which reads out waveform information from a waveform ROM 8 in which waveforms are prestored, at an address interval corresponding to the pitch of inputted performance information to generate a digital musical tone signal, and independently generates the musical signals of 64 channels at the same time by a time-shared operation. An effect adder circuit 7 is a circuit for adding, for instance, a reverberation effect to a musical signal, which consists of an arithmetic circuit and the like as described later, and uses a delay RAM 9 as a signal delay means. In addition, as shown by a dotted line in FIG. 2, when the musical tone generator circuit 6 and the effect adder circuit 7 are made on one LSI, the connections with the waveform ROM 8 and the delay RAM 9 also employ a bus connection construction by a memory bus 13, as is the connection with the CPU 1 (a bus 12), to decrease the number of terminals.

A D/A converter 10 performs a D/A conversion of a digital musical signal. A sound system 11 is comprised of an amplifier and speakers (or headphones, earphones or the like), and amplifies a musical tone signal to generate a musical tone. In addition, a MIDI interface circuit, the drivers (read and write devices) for storage media such as a floppy disk and a memory card may be provided.

FIG. 1 is a block diagram showing the construction of the musical tone generator circuit 6. A waveform address generator circuit 20, which will be detailed later, accumulates frequency information proportional to the frequency or a desired musical tone set from the CPU 1, and outputs in a time-shared manner an address WA for reading out a waveform sample value from the waveform ROM 8 for each channel. It also outputs the fractional part (the fractional part of the address) fr and an increment signal inc of the integral part i of the phase information of a musical signal for interpolation. A sample interpolation circuit 21, which will also be detailed later, is to temporarily store the plurality of waveform sample values read out from the waveform ROM 8, and it performs the interpolatory calculation of the waveform sample values on the basis of the fractional part fr of the phase information outputted from the waveform address generator circuit 20, and provides a sample value output W(i+fr).

An envelope generator circuit 22 generates a desired envelope signal by a well-known technique on the basis of the parameter set from the CPU 1. A multiplier 23 multiplies the sample value output W from the interpolatory circuit 21 by the envelope signal to generate a digital musical tone signal, and outputs it to the effect adder circuit 7. An interface circuit 24 comprises a synchronous circuit for synchronizing the data transfer from the CPU 1 with the operation timing within the musical tone generator circuit 6, and the like, and the data to be set is supplied to each circuit by an internal bus CD. A timing control circuit 25 includes a counter for specifying the time-shared calculation timing for each channel, and generates clock, address and latch signals for controlling the operation timing of the musical tone generator circuit 6.

Figure 3:
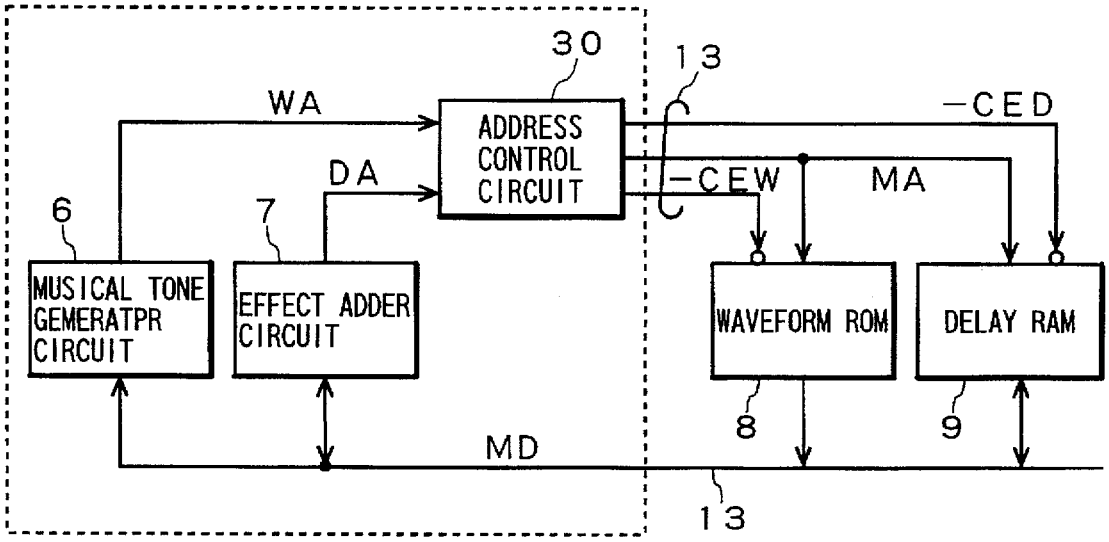
FIG. 3 is a block diagram showing the circuit related to a memory bus 13.

FIG. 3 is a block diagram showing the circuit related to the memory bus 13. Although not shown in FIG. 2, an address control circuit 30 exists between the musical tone generator circuit 6 or the effect adder circuit 7 and the memory bus 13. Inputted to this circuit are the read address WA of the waveform ROM 8 outputted from the musical tone generator circuit 6 and the read or write address DA of the delay RAM 9 outputted from the effect adder circuit 7, and it outputs a common address signal MA and different enable signals -CED and -CEW.

Figure 4:
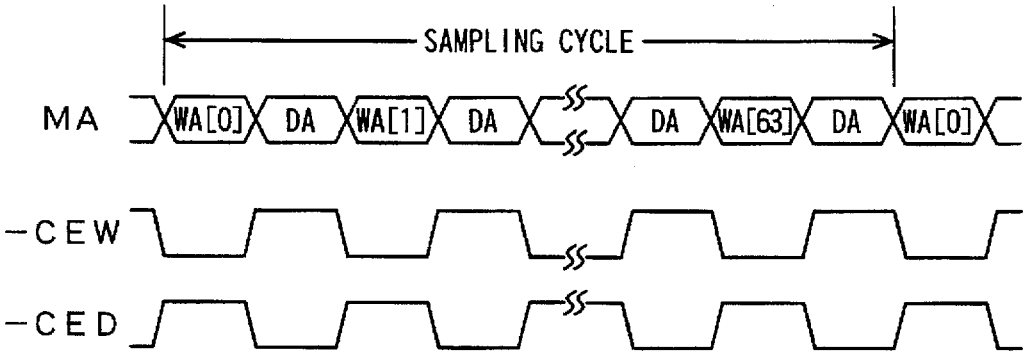
FIG. 4 is a timing chart showing the relationships between an address signal MA and respective enable signals.

FIG. 4 is a timing chart showing the relationships between the address signal MA and the respective enable signals. WA and DA are alternately outputted in MA, and the waveform sample values of the all channels from WA(0) to WA(63) are read out in one sampling cycle. -CEW is 0 (valid) when WA is outputted, and -CED is 0 (valid) when DA is outputted. A waveform sample value is read out from the waveform ROM 8 to a data bus MD In synchronism with -CEM and taken into the musical tone generator circuit 6, and the effect adder circuit 7 accesses the delay RAM 9 in synchronism with -CED.

Figure 5:
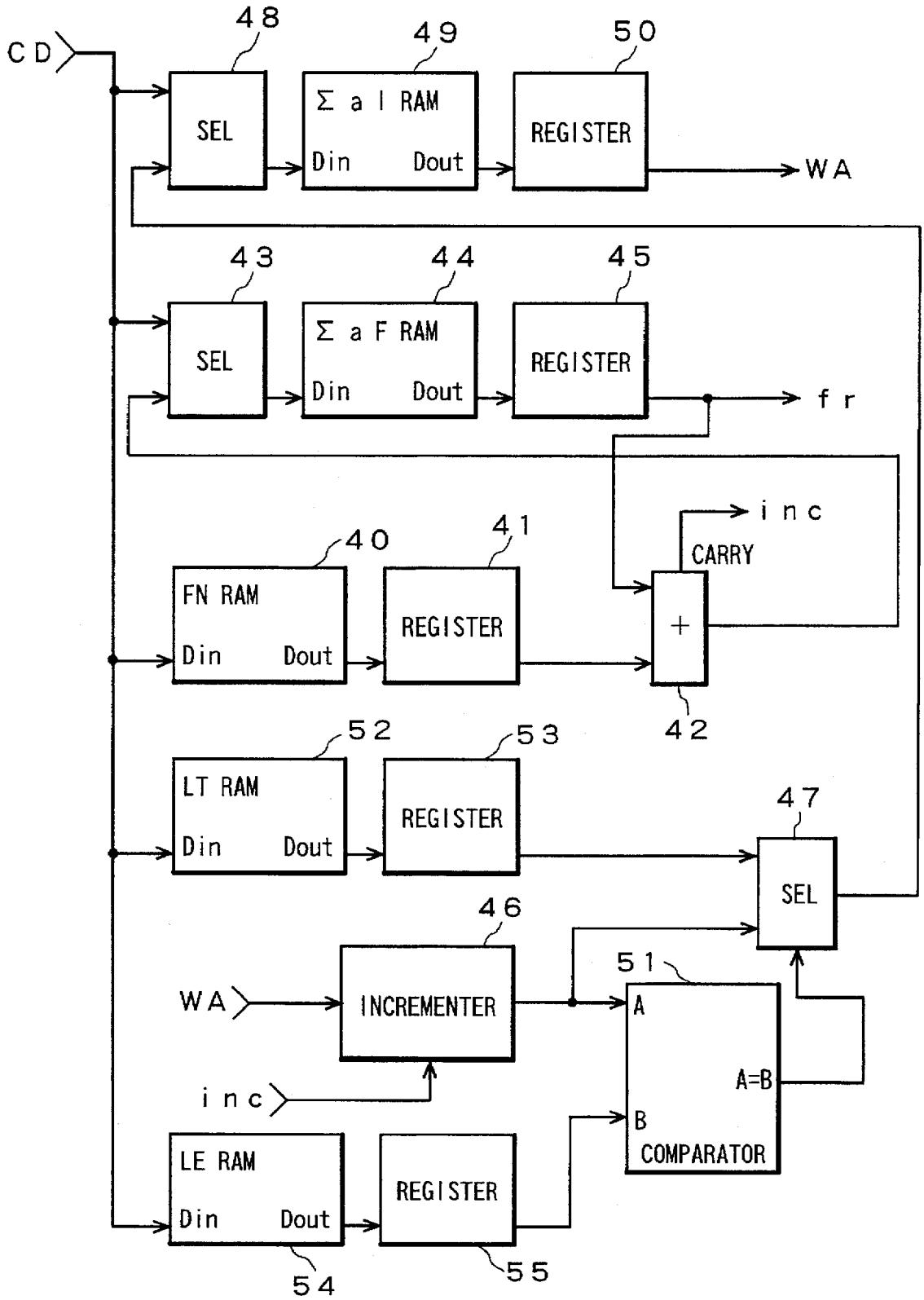
FIG. 5 is a block diagram showing the construction of a waveform address generator circuit 20.

FIG. 5 is a block diagram showing the construction of the waveform address generator circuit 20 of FIG. 1. FN-RAM 40 is a 64-word memory in which the waveform read frequency (address interval) information (in this embodiment, values smaller than one are employed) is stored for each channel, and the contents of this memory are set by the CPU 1. Except the writing by the CPU 1, the address is specified by a channel specifying counter, and the frequency information which was read out is latched in a register 41 and added by an adder 42 to the fractional part fr of the phase information. The adder 42 outputs only the fractional part of the resultant sum, and outputs a carry signal as the increment signal inc if the sum 1s one or greater. The output of the adder 42 is written, as the fractional part fr of new phase information, into a Σ aF-RAM 44 through a selector (SEL) 43. The selector 43 switches when the CPU 1 sets data in the RAM 44.

The increment signal inc initiates an incrementer (+1 adder) 46, which outputs a value obtained by adding one to the current read address WA to a comparator 51 and a selector 47. If the increment signal inc is not generated, the incrementer 46 directly outputs WA. The comparator 51 compares the output of the incrementer 46 with the loop end address read out from an LE-RAM 54. It generates a selector control signal so that the selector 47 outputs the output value of the incrementer 46 if the comparison result shows disagreement, and so that the loop top address read out from an LT-RAM 52 is outputted if the comparison result shows agreement. The output of the selector 47 is stored in a Σ aI-RAM 49 as a new read address WA. The Σ aI-RAM 49 is a 64-word RAM for storing the integral part I of the phase information of a musical tone waveform for each channel. Since the waveform address WA requires an advance read for interpolation, strictly speaking, it is set so that WA=i+3 (the CPU sets it as the start address information at the beginning of tone generating). The contents of the five RAMs can all be set from the CPU 1 through the internal bus CD.

Figure 11:
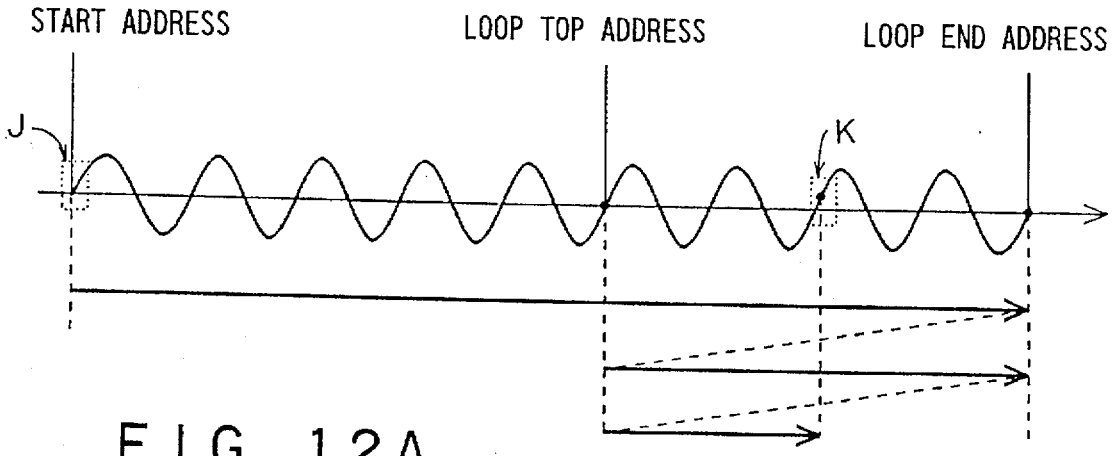
FIG. 11 is a conceptual view showing the waveform data stored in a waveform ROM 8.

FIG. 11 is a conceptual view showing the waveform data stored in the waveform ROM 8. The waveform data corresponding to one tone color is stored by a predetermined length from the beginning of tone generating to reduce the memory capacity, and a loop top address is set at the beginning of the latter portion where there is little tone color change. When the waveform data is read out, the reading is started from the start address, and the attack portion having a large tone color change is read out once, and when the loop end address is reached, a return to the loop top address is made and the readout of the waveform in the portion having little tone color change is repeated as necessary (the waveform in FIG. 11 is for the purpose of explanation and different from the actual one).

Figure 12A:
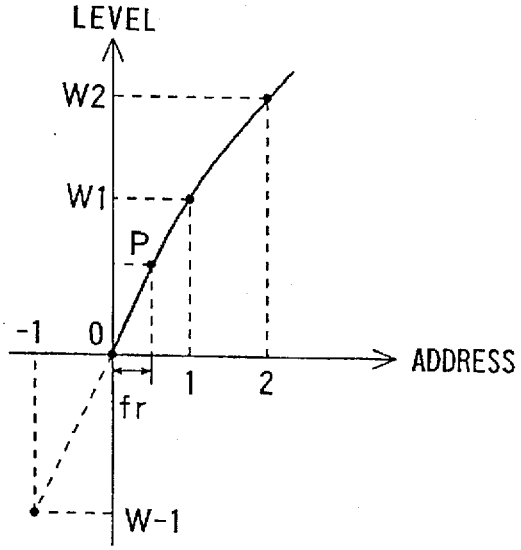
FIGS. 12A to 12C are conceptual views for explaining the interpolatory calculation.
Figure 12B:
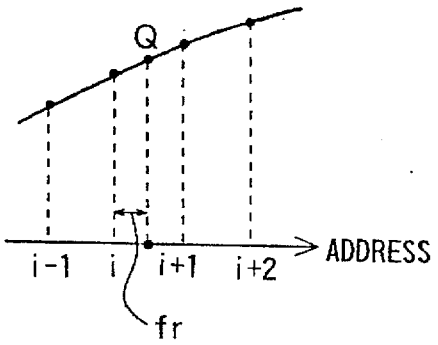
Figure 12C:
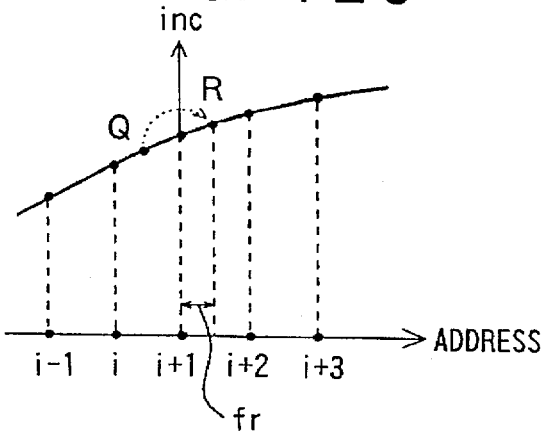

The interpolation is now described. FIGS. 12A to 12C are conceptual views for explaining the interpolatory calculation. FIG. 12A shows the relationship between the waveform sample value and the output musical tone signal level at the beginning of tone generating (J in FIG. 11), and FIGS. 12B and 12C show such relationships during the tone generating. In this embodiment, the interpolation is performed using four sampling values. Now, if it is assumed that four continuous sampling values are W(i−1), W(i), W(i+1), and W(i+2), and the interpolation coefficients determined by the fractional part fr of phase information are C(i−1), C(i), C(i+1) and C(i+2), then the interpolation output can be determined by the following equation. (* represents a multiplication.)

$$W(i+fr)=C(i-1)*W(i-1)+C(i)*W(i)+C(i+1)*W(i+1)+C(i+2)*W(i+2).$$

The interpolation coefficients C for the Lagrangian interpolation are $$C(i-1)=(1/6)*(fr*(fr*(fr*(-1)+3)-2)+0),$$

$$C(i)=(1/2)*(fr*(fr*(fr*(1)-2)-1)+2),$$

$$C(i+1)=(1/2)*(fr*(fr*(fr*(-1)+1)+2)+0),$$

and $$C(i+2)=(1/6)*(fr*(fr*(fr*(1)+0)-1)+0),$$

and for the interpolation by a B-spline curve, they are $$C(i-1)=(1/6)*(fr*(fr*(fr*(-1)+3)-3)+1),$$

$$C(i)=(1/6)*(fr*(fr*(fr*(3)-6)+0)+4),$$

$$C(i+1)=(1/6)*(fr*(fr*(fr*(-3)+3)+3)+1),$$

and $$C(i+2)=(1/6)*(fr*(fr*(fr*(1)+0)+0)+0).$$

In the present invention, any coefficient (or the other coefficients may be used.

In the FIG. 12B, only the sample value corresponding to the integral part (i) of the address is stored in the waveform ROM 8. If the current value of the phase information (address) is i+fr, the level of the current value Q is obtained from the four sample values from (i−1) to (i+2) and fr. Further, as shown in FIG. 12C, if the address is accumulated and the phase information exceeds (i+1), the increment signal inc is generated, and the sample value of (i+3) necessary for the interpolation of the current value R(i+1fr) is read out from the waveform memory 8 and accumulated in the sample interpolation circuit. Incidentally, the sample values from i to (i+2) were already read out and accumulated.

FIG. 12A shows the state at the beginning of tone generating, and to perform the interpolatory calculation when the current value P is between 0 and 1, the sample values W-1, 0, W1 and W2 corresponding to four address values −1, 0, 1 and 2 are required. However, the sample values have not been read out yet at the beginning of tone generating, and thus the correct interpolatory calculation cannot be performed. Accordingly in the present invention, a construction is provided in which the sample values necessary for the interpolatory calculation are transferred from the CPU 1 to the sample interpolation circuit 21 at the beginning of tone generating. Also, the sample values necessary for this are prestored, for example, in the ROM 2. Thus, it is only needed to prestore the data W3 corresponding to the address 3 and the subsequent data in the waveform ROM 8, and prestore W-1 to W2 in the ROM 2. In addition, if one sample value can be read out from the ROM 8 and can be used, it is only needed to prestore the data W2 corresponding to the address 2 and the subsequent data in the waveform ROM 8. If the first sample value W0 corresponding to the address 0 is always 0, W0 need not be prestored in the ROM 2.

Figure 6:
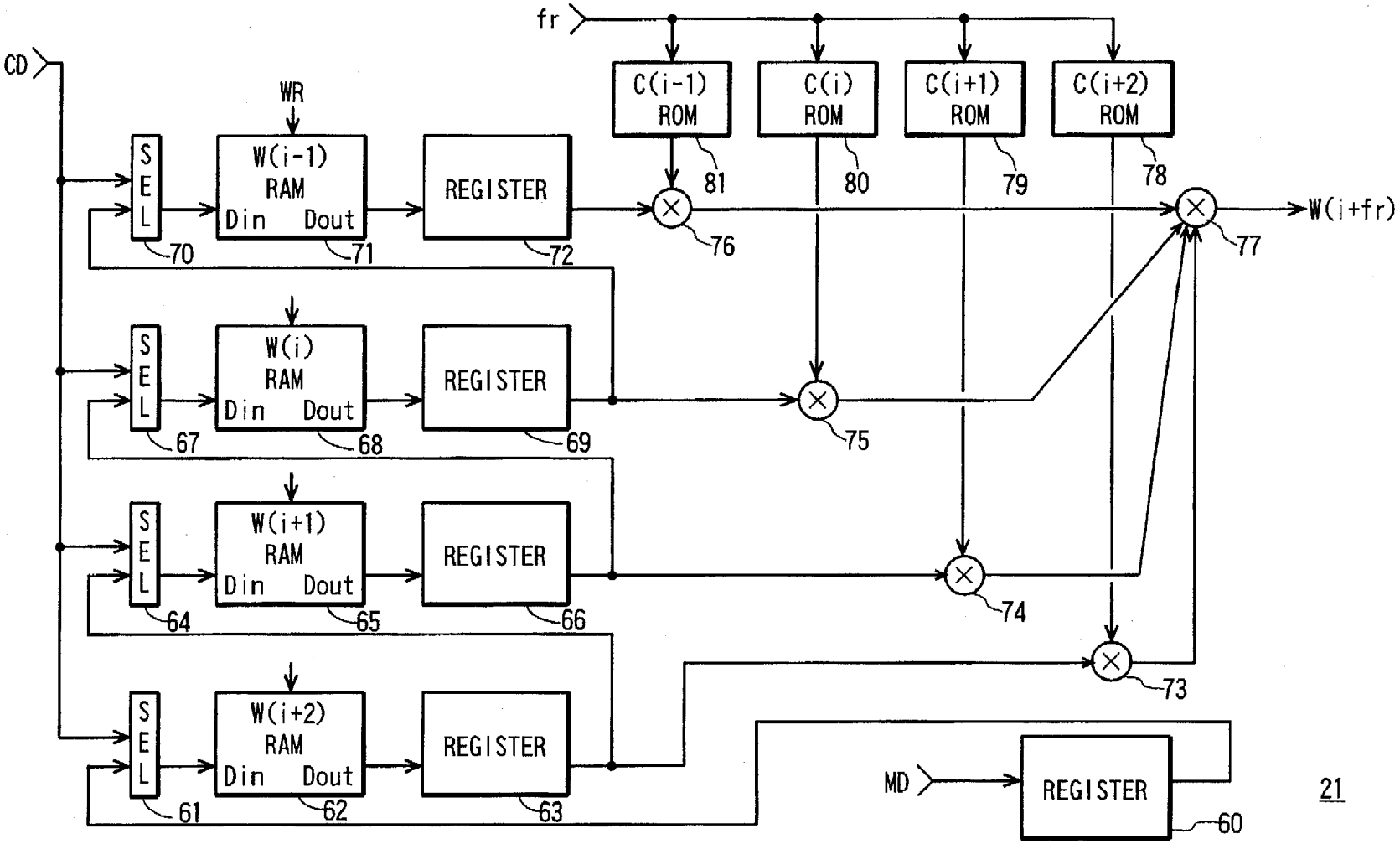
FIG. 6 is a block diagram showing the construction of the sample interpolation circuit 21 of the present invention.

FIG. 6 is a block diagram showing the construction of the sample interpolation circuit 21. Four RAMs 62, 65, 68 and 71 are 64-word memories for respectively storing the waveform sample values read out from the waveform ROM 8 for each channel. If the integral part of the current address is i, the sample value W(i+2) is stored in the W(i+2) RAM 62, and similarly, W(i+1) is stored in the W(i+1) RAM 65, W(i) is stored in the W(i) RAM 68, and W(i−1) is stored in the W(i−1) RAM 71. If the increment signal inc is generated, a write signal WR is outputted from the timing control circuit 25, data MD (=W(i+3)) read out from the waveform ROM 8 is written into the W(i+2) RAM 62, W(i+2) is written into the subsequent W(i+1) RAM W(i+1) is written into the W(i) RAM 68, and W(i) is written into the w(i−1) RAM 71.

Further, since there is remaining unrelated data in each RAM at the beginning of tone generating, the necessary sample values are transferred from the CPU to each RAM through selectors (SEL) 61, 64, 67 and 70, respectively. Registers 63, 66, 69 and 72 are to hold the output of each RAM, respectively, and a register 60 is to latch the waveform sample value data from the memory bus 13.

A C(i+2) ROM 78, a C(i+1) ROM 79, a C(i) ROM 80 and a C(i−1) ROM 81 are ROMs for storing the above described interpolation coefficients C(i+2), C(i+1), C(i) and C(i−1), respectively, and the corresponding interpolation coefficients are read out by using the phase information fr as an address. Multipliers 73, 74, 75 and 76 multiply the read interpolation coefficients by the sample values for interpolation which were read out from the RAMs, respectively. The outputs of the respective multipliers are added together by an adder 77 to output an interpolated sample value W(i+fr).

Figure 7:
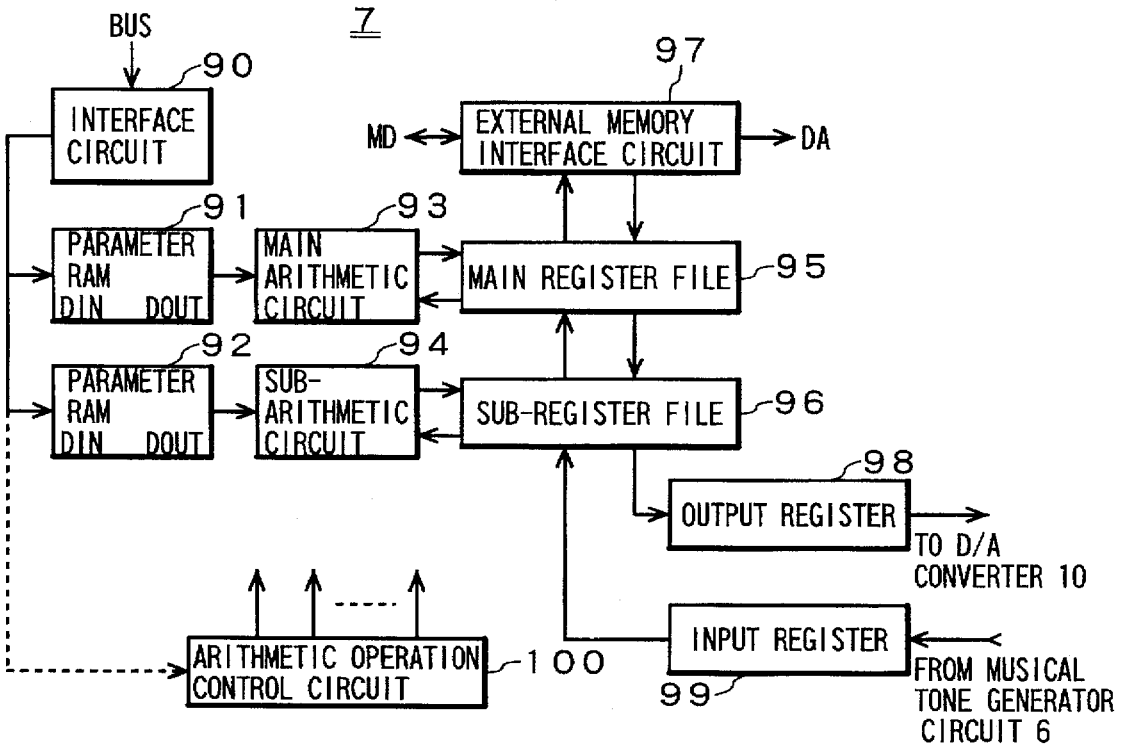
FIG. 7 is a block diagram showing the construction of an effect adder circuit 7.

FIG. 7 is a block diagram showing the construction of the effect adder circuit 7. An interface circuit 90 provides the interface with the bus 12 and consists of a synchronous circuit for synchronizing the data transfer from the CPU 1 with the operation timing within the effect adder circuit 7, and the like, and data is supplied to each parameter RAM 91, 92, or an arithmetic operation control circuit 100. The arithmetic operation control circuit 100 comprises, for instance, an instruction memory for storing an operation control microprogram, an instruction decoder for decoding instructions which are read out, etc., and it generates various control signals for controlling the arithmetic operation of the effect adder circuit 7.

In this embodiment, the instruction memory is constructed by a RAM, and the contents thereof are set by the CPU 1. However, if it is not needed to change the arithmetic operation mode of the effect adder circuit 7, the instruction memory may be a RAM or the control circuit may be designed by a wired logic. The parameter RAMs 91 and 92 are memories for storing the operation parameters for a main arithmetic circuit 93 and a sub-arithmetic circuit 94, respectively, and the parameters to be stored include input/output gain coefficients, filter coefficients, various coefficients for the calculations for creating reverberation sounds, delay length of a musical tone signal (number of delay samples), and the like. These parameters are set from the CPU 1 through the inter face circuit 90.

A main register file 95 and a sub-register file 96 consist of a plurality of registers mainly for temporarily storing data during the arithmetic operation, and also used as delay means for implementing IIR filters of first or second order. Further, data is sent or received between an input register 99, an output register 98 or an external memory interface circuit 97 and the register file, or between the register files. The main register file 95 has a word length of the order of 32 bits, and the sub-register file has a word length of the order of 20 bits. The external memory interface circuit 97 is an access control circuit for the delay RAM 9 connected to the memory bus 13, and outputs address information of the delay RAM 9 to send out data to be written to the memory bus, or take in read-out data and transfer it to the register file 95.

Figure 8:
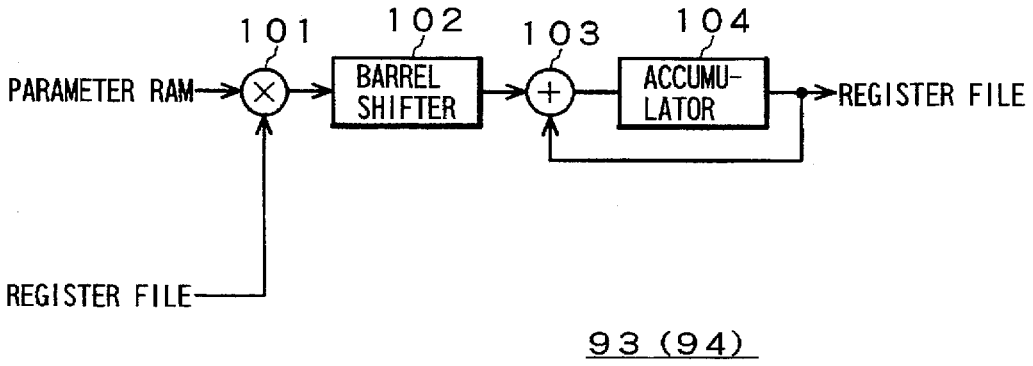
FIG. 8 is a block diagram showing the construction of an arithmetic circuit 93 (94).

The main and sub-arithmetic circuits 93 and 94 have a construction, for instance, as shown in FIG. 8. In FIG. 8, a multiplier 101 multiplies the data from the register file by the data from the parameter RAM, and outputs the result to a barrel shifter 102. The barrel shifter 102 shifts the input data by a desired number of digits, and outputs it to an adder 103. The adder 103 adds the output of an accumulator 104 and the output of the barrel shifter 102, and outputs the sum to the accumulator 104. The accumulator 104 is a register for temporarily storing data, the output of which is also outputted to the register file.

Figure 9:
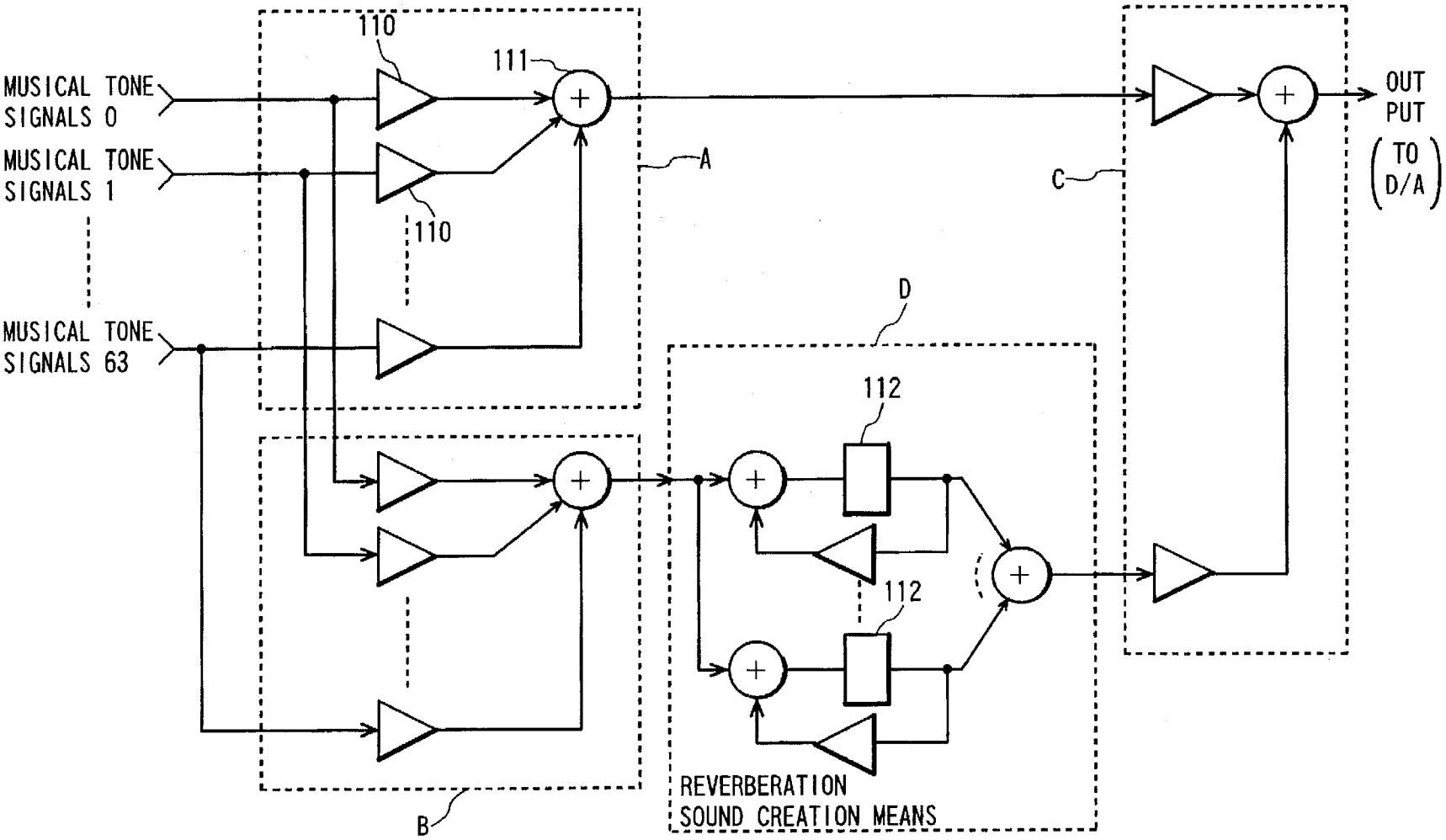
FIG. 9 is a functional block diagram showing the arithmetic contents of the effect adder process.

FIG. 9 Is a functional block diagram showing the operation result of the effect addition processing in the effect adder circuit of FIG. 7. In a block A, the musical tone signals of a plurality of channels which are generated from the musical tone generator circuit 6 are multiplied in multipliers 110 by the coefficients corresponding to desired gain ratios, respectively, and added or mixed by an adder 111. The triangles in FIG. 9 are all multipliers, and the circles having a plus sign therein are adders. Also in a block B, a similar operation is performed, but the coefficients of the multipliers determine the extent to which the signals of the channels are inputted to the reverberation sound creating means. In a block C, the musical tone signals generated from the blocks A and D are multiplied by coefficients corresponding to the mixing ratios of reverberation sounds, respectively, and added by an adder to provide an output signal. The above operations in the blocks A, B and C are executed by the sub-arithmetic operation circuit 94, and thus, in the sub-arithmetic operation circuit 94, the multiplier has a precision of the order of 16×12 bits, and the adder has a precision of about 24 bits.

In the block D, a reverberation sound creation processing is performed. Various methods for creating a reverberation sound were proposed. In an example of them, the output signals delayed by a plurality of delay elements 112 (implemented by the delay RAM 9) having different delay times, are multiplied by predetermined coefficients, respectively. The output signals of the respective multipliers are added to the input signal and inputted to the delay elements, respectively. And a reverberation sound is created by adding or mixing the output signals of the respective delay elements. This operation for creating a reverberation sound is performed by the main arithmetic operation circuit 93. A high operation precision is required for the creation of a reverberation sound as shown, or for the operation including a feedback loop such as an IIR filter or the like. Accordingly, in the main arithmetic operation circuit 93, the multiplier has a precision of the order of 24×16 bits, and the adder has a precision of about 36 bits. In addition, as the delay RAM, it is needed to delay several hundreds to several tens of thousands of samples.

Figure 10:
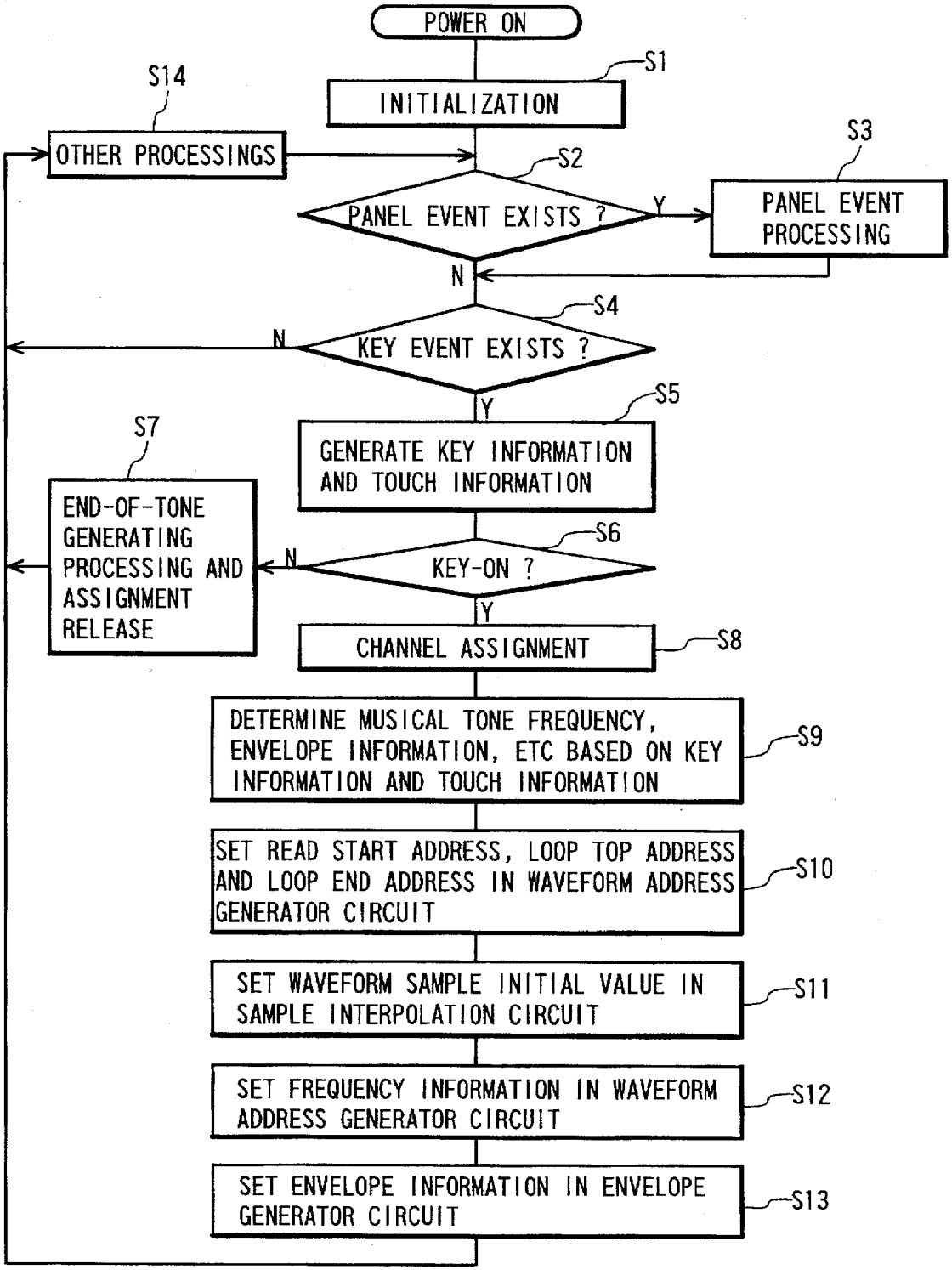
FIG. 10 is a flowchart showing the main processing of the CPU 1 of the electronic musical instrument.

FIG. 10 is a flowchart showing the main process by the CPU 1 of the electronic musical instrument to which the present invention was applied. When the power is turned on, the registers and memories in the CPU 1, RAM 3, musical tone generator circuit 6 and effect adder circuit 7 are initialized in step S1. In step S2, it is determined whether or not a panel event exists, and the process goes to step S3 if the result is positive. The panel event means a change in the state (from on to off, or vice versa) of a switch or the like on the panel. In step S3, based on the state change of each switch, the corresponding panel event processing is performed.

In step S4, it is determined whether or not there is a key event, and the process goes to step S14 if the result is negative, but to step S5 if the result is positive. In step S5, key number information and touch information are generated, and in step S6, it is determined whether or not the key event is a key-on. If the result is positive, the process goes to step S8; otherwise the process goes to step S7. In step S7, an end-of-tone generating process is carried out, and the channel assignment is released if the tone generating fully attenuates. If, in step S6, there is a key-on, the process goes to step S8 where the tone generating corresponding to the key-on is assigned to a free musical tone generating channel of the musical tone generator circuit 6.

In step S9, the frequency, tone color and envelope information are determined on the basis of the key information and touch information. In step S10, the read start address, loop top address and loop end address are determined by the tone color information, etc. are set in the ΣaI-RAM 49, LT-RAM 52 and LE-RAM 54 in the waveform address generator circuit 20, respectively. In step S11, the waveform sample initial value corresponding to the start address of step S10 stored, for instance, in the ROM 2 1s set in each RAM within the sample interpolation circuit 21. In step S12, the frequency information is set in the FN-RAM 40 within the waveform address generator circuit 20. In step S13, the envelope information 1s set in the envelope generator circuit 22. In step S14, a MIDI processing, an automatic performance processing an effect addition processing and the like are carried out, and the process returns to step S2.

Although the embodiment has been described above the following variations are also possible. Regarding the interpolatory calculation, an example has been disclosed in which the four sample values before and after the current value, but an interpolatory calculation using any number of, for instance, two or more sample values is possible. An example has been disclosed in which the interpolation coefficients C are prestored in the ROM, but they may be calculated from the fractional part fr of the phase information on the basis of the above described equation. If the waveform memory is accessible from the CPU, the plurality of waveform sample values needed for the interpolatory calculation at the beginning of tone generating may be prestored in the waveform memory. Although a circuit for adding a reverberation sound has been disclosed as the effect adder circuit, any effect addition processing such as a filter processing can be implemented, for instance, by altering the microprogram of the effect adder circuit.

What is claimed is:

1. A musical tone generator comprising:

a first waveform memory means for storing a musical tone waveform, an interpolation means for performing an interpolatory calculation on the basis of a plurality of continuous waveform sample values, a second waveform memory means in which at least, the sample values needed for the interpolatory calculation at the beginning of tone generating are stored, and a transfer means for reading out the sample values from said second waveform memory means and writing them into said interpolation means at the beginning of tone generating.

2. A musical tone generator as set forth in claim 1 wherein the waveform sample value data in said second waveform memory means and the waveform sample value data in said first waveform memory means are not overlapping with each other, and are continuous.

3. A musical tone generator as set forth in claim 1 wherein said second waveform memory means 1s a memory in which a program for controlling an electronic musical instrument is stored.

4. A musical tone generator as set forth in claim 1 wherein said interpolation means performs an interpolatory calculation based on four sample values.

5. A musical tone generator as set forth in claim 4 wherein said second waveform memory means has stored therein the sample values for two points.

6. A musical tone generator comprising:

a musical tone generating instruction means for instructing the generation of a musical tone, a phase information generator means for accumulating the frequency information corresponding to the pitch instructed by said musical tone generating instruction means, thereby to generate phase information consisting of an integral part and a fractional part, a first waveform memory means in which waveform sample values are stored, and from which the waveform sample values are read out correspondingly to the integral part of the phase information generated by said phase information generator means, a sample value memory means for temporarily storing the continuous waveform sample values read out from said first waveform memory means, an interpolation means for obtaining the waveform sample value corresponding to the phase information by an interpolatory calculation on the basis of the contents of said sample value memory means and the fractional part of the phase information, a second waveform memory means in which the waveform sample values needed for the interpolatory calculation at the beginning of tone generating are stored, and a transfer means for reading out waveform sample values from said second waveform memory means and transferring them to said sample value memory means if the start of a tone generating is instructed by said musical tone generating instruction means.

7. A musical tone generator as set forth in claim 6 wherein said sample value memory means consists of a plurality of cascaded memories, the stored sample values are are sequentially transferred between said plurality of memories each time a new sample value is read out from said waveform memory means, and said transfer means can transfer sample values to any memory of said plurality of memories.

8. A musical tone generator comprising:

a waveform memory means for storing musical tone waveforms, an interpolation means for performing an interpolatory calculation on the basis of a plurality of continuous waveform sample values, and a sample value transfer means for reading out the sample values necessary for the interpolatory calculation from said waveform memory means at the beginning of tone generating, and writing them into said interpolation means through one of a plurality of transfer paths coupled thereto.

* * * * *